US011131305B2

(12) United States Patent
Mizushima et al.

(10) Patent No.: US 11,131,305 B2
(45) Date of Patent: Sep. 28, 2021

(54) SCROLL COMPRESSOR HAVING CUTOUT PROVIDED ON MOVABLE WRAP TO REDUCE BACKFLOW

(71) Applicant: DAIKIN INDUSTRIES, LTD., Osaka (JP)

(72) Inventors: Yasuo Mizushima, Osaka (JP); Yasuhiro Murakami, Osaka (JP); Ryouta Nakai, Osaka (JP); Masahiro Noro, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 190 days.

(21) Appl. No.: 16/320,881

(22) PCT Filed: Jul. 24, 2017

(86) PCT No.: PCT/JP2017/026710
§ 371 (c)(1),
(2) Date: Jan. 25, 2019

(87) PCT Pub. No.: WO2018/021245
PCT Pub. Date: Feb. 1, 2018

(65) Prior Publication Data

US 2019/0162185 A1 May 30, 2019

(30) Foreign Application Priority Data

Jul. 29, 2016 (JP) ..... JP2016-150614

(51) Int. Cl.
*F04C 18/02* (2006.01)

(52) U.S. Cl.
CPC ..... *F04C 18/0246* (2013.01); *F04C 18/02* (2013.01); *F04C 18/0215* (2013.01); *F04C 18/0261* (2013.01)

(58) Field of Classification Search
CPC .. F04C 18/0215; F04C 18/02; F04C 2210/22; F04C 2250/102; F04C 29/12;
(Continued)

(56) References Cited

U.S. PATENT DOCUMENTS 4,781,549 A * 11/1988 Caillat ..... F01C 1/0246 418/150
5,242,283 A 9/1993 Mori et al.
(Continued)

FOREIGN PATENT DOCUMENTS

JP 5-202864 A 8/1993
JP 8-21381 A 1/1996
(Continued)

OTHER PUBLICATIONS

International Preliminary Report of corresponding PCT Application No. PCT/JP2017/026710 dated Feb. 7, 2019.
(Continued)

*Primary Examiner* — Mary Davis
*Assistant Examiner* — Paul W Thiede
(74) *Attorney, Agent, or Firm* — Global IP Counselors, LLP

(57) ABSTRACT

A scroll compressor includes a fixed scroll, a movable scroll revolvable with respect to the fixed scroll, and a crankshaft rotatable to cause the movable scroll to revolve. A discharge port is formed in a first scroll of the fixed scroll or the movable scroll. A cutout portion is formed in a second scroll of the fixed scroll or the movable scroll. The cutout portion formed in the second scroll at least partially passes through a profile of the discharge port formed in the first scroll because of revolution of the movable scroll.

10 Claims, 8 Drawing Sheets

(58) Field of Classification Search
CPC ..... F04C 23/008; F04C 18/0261; F04C 18/0269; F04C 18/0284; F04C 2250/201; F04C 2250/10; F04C 1/04; F04C 28/18; F04C 15/06; F04C 18/0246; F04C 2240/30
USPC ..... 418/15, 55.1–55.6, 97, 150, 182; 417/410.1, 412; 384/29, 95, 129, 255, 384/276, 290, 296, 447; 428/403
See application file for complete search history.

(56) References Cited

U.S. PATENT DOCUMENTS

| | | | | |
|---|---|---|---|---|
| 2002/0094292 | A1* | 7/2002 | Fujita | F04C 18/0276 418/55.2 |
| 2019/0264688 | A1* | 8/2019 | Mizushima | F04C 18/02 |

FOREIGN PATENT DOCUMENTS

| | | | |
|---|---|---|---|
| JP | 11-13659 | A | 1/1999 |
| JP | 2001-140778 | A | 5/2001 |
| JP | 2014-105589 | A | 6/2014 |

OTHER PUBLICATIONS

European Search Report of corresponding EP Application No. 17 83 4251.5 dated Nov. 21, 2019.
International Search Report of corresponding PCT Application No. PCT/JP2017/026710 dated Oct. 3, 2017.

* cited by examiner

SCROLL COMPRESSOR HAVING CUTOUT PROVIDED ON MOVABLE WRAP TO REDUCE BACKFLOW

CROSS-REFERENCE TO RELATED APPLICATIONS

This U.S. National stage application claims priority under 35 U.S.C. § 119(a) to Japanese Patent Application No. 2016-150614, filed in Japan on Jul. 29, 2016, the entire contents of which are hereby incorporated herein by reference.

TECHNICAL FIELD

The present invention relates to a scroll compressor.

BACKGROUND ART

A scroll compressor has a fixed scroll and a movable scroll that possess a shape such as an involute curve. The capacities of compression chambers defined by the fixed scroll and the movable scroll become smaller with the revolving movement of the movable scroll, whereby fluid compression is performed. The compression chambers and a discharge port communicate with each other at a timing when the capacities of the compression chambers generally reach a minimum, and high-pressure fluid that has been compressed is discharged from the discharge port to the outside.

In the scroll compressor that JP-A No. 2014-105589 discloses, the shape of the profile of the discharge port is designed in such a way that, at the moment when the compression chambers and the discharge port communicate with each other, a communication area between the discharge port and the compression chambers suddenly becomes larger, to thereby try to reduce pressure loss of the fluid at the discharge port.

SUMMARY

In a case where the communication area suddenly becomes larger at the moment when the compression chambers and the discharge port communicate with each other, sometimes backflow of the fluid occurs. When the fluid that has been discharged once becomes compressed again because of backflow, pressure loss arises as a result. There are cases where the magnitude of the pressure loss resulting from this backflow exceeds the reduction in pressure loss obtained by ensuring the size of the communication area at the moment of communication.

It is a problem of the present invention to improve the performance of a scroll compressor by reducing pressure loss throughout the entire operation of the scroll compressor.

A scroll compressor pertaining to a first aspect of the invention has a fixed scroll, a movable scroll, and a crankshaft. The movable scroll can revolve with respect to the fixed scroll. The crankshaft can rotate while causing the movable scroll to revolve. A discharge port is formed in one of the fixed scroll or the movable scroll, and a cutout portion is formed in the other. The cutout portion formed in the other at least partially passes through the profile of the discharge port formed in the one because of the revolution of the movable scroll.

According to this configuration, when the cutout portion formed in the other passes through the profile of the discharge port, the compression chambers and the discharge port communicate with other in a small flow passage area. Consequently, some of the fluid inside the compression chambers is discharged at a low flow rate, whereby the pressure of the fluid inside the compression chambers becomes lower, so backflow of the fluid to the compression chambers can be reduced.

A scroll compressor pertaining to a second aspect of the invention is the scroll compressor pertaining to the first aspect, wherein the cutout portion is a sloping portion or a step portion.

According to this configuration, the cutout portion is a sloping portion or a step portion. Consequently, it is easy to form the cutout portion.

A scroll compressor pertaining to a third aspect of the invention is the scroll compressor pertaining to the first aspect or the second aspect, wherein the fixed scroll has a fixed scroll flat plate portion and a fixed scroll spiral portion. The fixed scroll spiral portion is erected on the fixed scroll flat plate portion. The movable scroll has a movable scroll flat plate portion and a movable scroll spiral portion. The movable scroll spiral portion is erected on the movable scroll fiat plate portion. The discharge port is formed in the fixed scroll flat plate portion. The cutout portion is formed in the movable scroll spiral portion.

According to this configuration, the discharge port is formed in the fixed scroll. Consequently, the discharge port does not move, so it is easy to design a guide path for the discharge fluid that becomes discharged from the compression element.

A scroll compressor pertaining to a fourth aspect of the invention is the scroll compressor pertaining to the third aspect, wherein the discharge port is formed in the center of the fixed scroll flat plate portion. The cutout portion is formed in an outer edge of the movable scroll spiral portion.

According to this configuration, the discharge port is formed in the center of the fixed scroll. Consequently, the fluid that has been compressed with high compressibility can be discharged at the center of the fixed scroll.

A scroll compressor pertaining to a fifth aspect of the invention is the scroll compressor pertaining to the first aspect or the second aspect, wherein the fixed scroll has a fixed scroll flat plate portion and a fixed scroll spiral portion. The fixed scroll spiral portion is erected on the fixed scroll flat plate portion. The movable scroll has a movable scroll flat plate portion and a movable scroll spiral portion. The movable scroll spiral portion is erected on the movable scroll flat plate portion. The discharge port is formed in the movable scroll flat plate portion. The cutout portion is formed in the fixed scroll spiral portion.

According to this configuration, the cutout portion is formed in the fixed scroll. Consequently, backflow of the fluid can be inhibited or reduced in a case where, because of design constraints, it is necessary to provide the discharge port in the movable scroll.

A scroll compressor pertaining to a sixth aspect of the invention is the scroll compressor pertaining to the fifth aspect, wherein the discharge port is formed in the center of the movable scroll flat plate portion. The cutout portion is formed in an outer edge of the fixed scroll spiral portion.

According to this configuration, the discharge port is formed in the center of the movable scroll. Consequently, the discharge port comparatively does not move, so it is comparatively easy to design a guide path for the discharge fluid.

A scroll compressor pertaining to a seventh aspect of the invention is the scroll compressor pertaining to any one of the first aspect to the sixth aspect, wherein the fixed scroll and the movable scroll define compression chambers for compressing a fluid. The other at least partially covers the discharge port and thereby can change a communication area. The communication area is the area of a portion of the total area of the discharge port that contributes to communication with the compression chambers. A first rotation angle position corresponds to a disposition in which the compression chambers and the discharge port start communicating with each other. A second rotational angle position is a preliminary discharge interval angle greater than the first rotation angle position. As the crankshaft rotates from the first rotation angle position to the second rotation angle position, the communication area increases at a first rate of increase. A third rotation angle position is greater than the second rotation angle position. As the crankshaft rotates from the second rotation angle position to the third rotation angle position, the communication area increases at a second rate of increase. The second rate of increase is greater than the first rate of increase.

According to this configuration, for a predetermined amount of time after the compression chambers and the discharge port start communicating with each other, that is, as the crankshaft rotates from the first rotation angle position to the second rotation angle position, the communication area gently increases. At this time, some of the fluid inside the compression chambers is discharged at a low flow rate, whereby the pressure of the fluid inside the compression chambers becomes lower. Consequently, backflow of the fluid to the compression chambers as the crankshaft thereafter rotates from the second rotation angle position to the third rotation angle position can be reduced.

A scroll compressor pertaining to an eighth aspect of the invention is the scroll compressor pertaining to the seventh aspect, wherein the preliminary discharge interval angle is 20° to 60°.

According to this configuration, the preliminary discharge interval angle having a predetermined size is ensured. Consequently, backflow of the fluid can be more reliably inhibited or reduced.

A scroll compressor pertaining to a ninth aspect of the invention is the scroll compressor pertaining to the seventh aspect or the eighth aspect, wherein the communication area in the second rotation angle position is 7% to 15% of the total area of the discharge port.

According to this configuration, as the crankshaft rotates from the first rotation angle position to the second rotation angle position, the communication area exposes up to 7% to 15% of the total area of the discharge port. Consequently, the discharge stage with a low flow rate can be reliably realized.

A scroll compressor pertaining to a tenth aspect of the invention is the scroll compressor pertaining to any one of the seventh aspect to the ninth aspect, wherein the second rate of increase is two or more times the first rate of increase.

According to this configuration, the second rate of increase relating to the discharge stage with the high flow rate is two or more times the first rate of increase relating to the discharge stage with the low flow rate. Consequently, the flow rates in the two discharge stages change significantly, so backflow reduction becomes reliable, i.e., backflow reduction is improved.

A scroll compressor pertaining to an eleventh aspect of the invention is the scroll compressor pertaining to any one of the seventh aspect to the tenth aspect, wherein the third rotation angle position is 90° or more greater than the second rotation angle position.

According to this configuration, the difference between the second rotation angle position and the third rotation angle position is defined. Consequently, in the discharge stage with the high flow rate, the range of the rotation angle position of the crankshaft involving the increase of the communication area is determined.

A scroll compressor pertaining to a twelfth aspect of the invention is the scroll compressor pertaining to any one of the first aspect to the eleventh aspect, wherein a recessed portion is formed in the other of the fixed scroll or the movable scroll, and a cutout portion is formed in the one. The cutout portion formed in the one at least partially passes through the profile of the recessed portion because of the revolution of the movable scroll.

According to this configuration, when the cutout portion formed in the one passes through the profile of the recessed portion, the compression chambers and the discharge port communicate with each other in a small flow passage area. Consequently, some of the fluid inside the compression chambers is discharged at a low flow rate, whereby the pressure of the fluid inside the compression chambers becomes lower, so backflow of the fluid to the compression chambers can be further reduced.

According to the scroll compressor pertaining to the first aspect, the seventh aspect, the eighth aspect, and the twelfth aspect of the invention, backflow of the fluid to the compression chambers can be reduced.

According to the scroll compressor pertaining to the second aspect of the invention, it is easy to form the cutout portion.

According to the scroll compressor pertaining to the third aspect of the invention, the discharge port does not move, so it is easy to design a guide path for the discharge fluid that becomes discharged from the compression element.

According to the scroll compressor pertaining to the fourth aspect of the invention, the fluid compressed with high compressibility can be discharged at the center of the fixed scroll.

According to the scroll compressor pertaining to the fifth aspect of the invention, backflow of the fluid can be inhibited or reduced in a case where, because of design constraints, it is necessary to provide the discharge port in the movable scroll.

According to the scroll compressor pertaining to the sixth aspect of the invention, the discharge port comparatively does not move, so it is comparatively easy to design a guide path for the discharge fluid.

According to the scroll compressor pertaining to the ninth aspect of the invention, the discharge stage with the low flow rate can be realized.

According to the scroll compressor pertaining to the tenth aspect of the invention, the flow rates in the two discharge stages change significantly, so backflow reduction becomes reliable, i.e., backflow reduction is improved.

According to the scroll compressor pertaining to the eleventh aspect of the invention, in the discharge stage with the high flow rate, the range of the rotation angle position of the crankshaft involving the increase of the communication area is determined.

DETAILED DESCRIPTION OF EMBODIMENT(S)

First Embodiment (1) Overall Configuration

Figure 1:
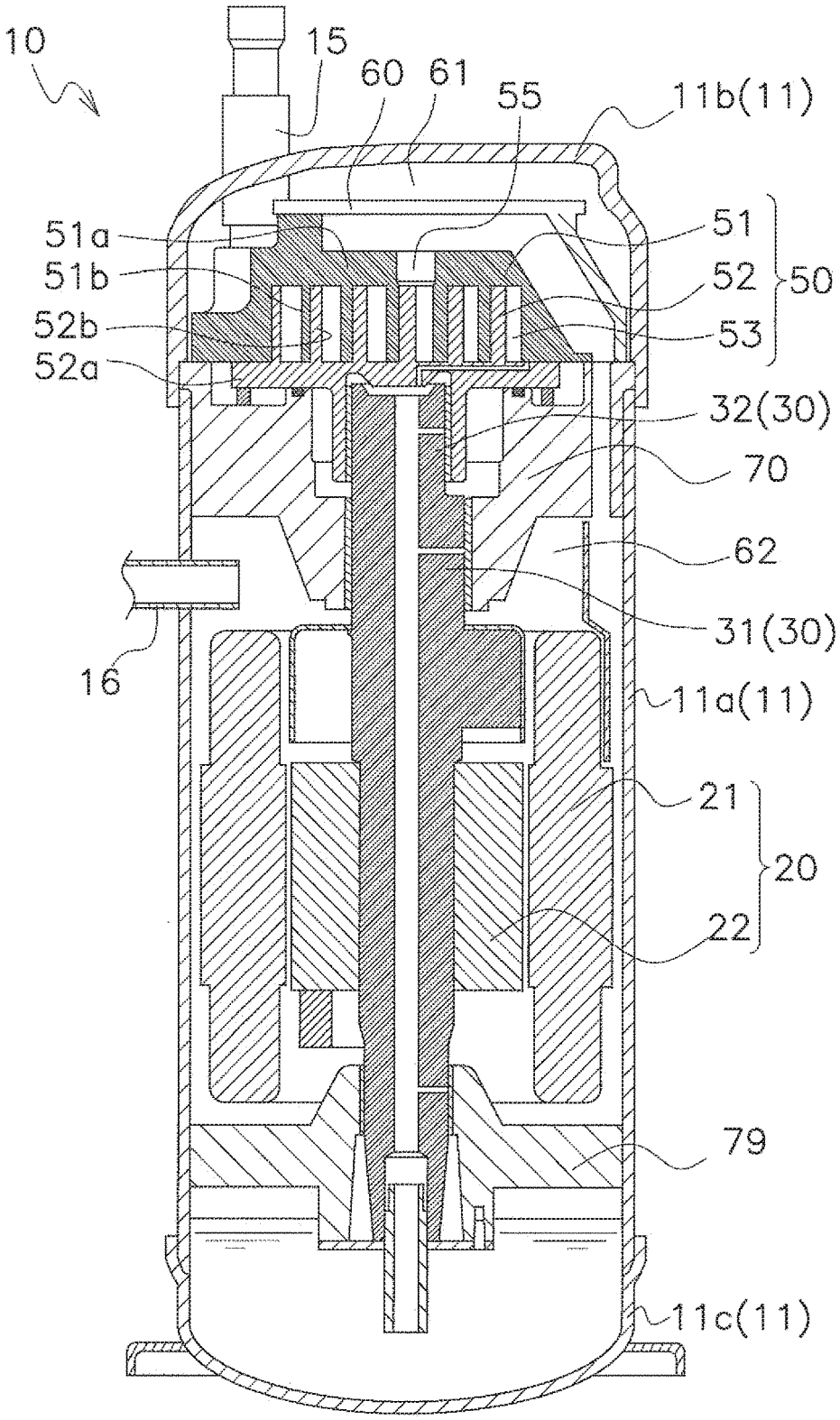
FIG. 1 is a sectional view of a scroll compressor 10 pertaining to a first embodiment of the invention.

FIG. 1 is a sectional view of a scroll compressor 10 pertaining to a first embodiment of the invention. The scroll compressor 10 compresses fluid low-pressure refrigerant it has sucked in into high-pressure refrigerant and discharges the high-pressure refrigerant. The scroll compressor 10 has a casing 11, a motor 20, a crankshaft 30, a compression element 50, and a high-pressure space forming member 60.

(2) Detailed Configuration (2-1) Casing 11

The casing 11 houses constituent elements of the scroll compressor 10. The casing 11 has a middle body portion 11*a* and also an upper portion 11*b* and a lower portion 11*c* that are secured to the middle body portion 11*a*, and forms an inside space. The casing 11 has a strength able to withstand the pressure of the high-pressure refrigerant existing in the inside space. In the casing 11 are provided a suction pipe 15 for sucking in the low-pressure refrigerant that is a fluid and a discharge pipe 16 for discharging the high-pressure refrigerant that is a fluid.

(2-2) Motor 20

The motor 20 generates power needed for the compression operation. The motor 20 has a stator 21, which is directly or indirectly secured to the casing 11, and a rotor 22 that can rotate. The motor is driven by electrical power supplied by a conductor wire not shown in the drawings.

(2-3) Crankshaft 30

The crankshaft 30 is for transmitting to the compression element 50 the power generated by the motor 20. The crankshaft 30 is pivotally supported by hearings secured to a first bearing securing member 70 and a second bearing securing member 79 and can rotate together with the rotor 22. The crankshaft 30 has a main shaft portion 31 and an eccentric portion 32. The main shaft portion 31 is secured to the rotor 22.

(2-4) Compression Element 50

The compression element 50 compresses the low-pressure refrigerant into the high-pressure refrigerant. The compression element 50 has a fixed scroll 51 and a movable scroll 52. Moreover, compression chambers 53, in which the compression operation is performed, are formed in the compression element 50.

(2-4-1) Fixed Scroll 51

The fixed scroll 51 is directly or indirectly secured to the casing 11. The fixed scroll 51 has a flat plate-shaped end plate 51*a* and a wrap 51*b* that is erected on the end plate 51*a*. The wrap 51*b* is spiral and has the shape of an involute curve, for example. A discharge port 55 is formed in the center of the end plate 51*a*.

(2-4-2) Movable Scroll 52

The movable scroll 52 is attached to the eccentric portion 32 of the crankshaft 30 and can revolve while sliding against the fixed scroll 51 because of the rotation of the crankshaft 30. The movable scroll 52 has a flat plate-shaped end plate 52*a* and a wrap 52*b* that is erected on the end plate 52*a*. The wrap 52*b* is spiral and has the shape of an involute curve, for example.

(2-4-3) Compression Chambers 53

The compression chambers 53 are spaces surrounded by the fixed scroll 51 and the movable scroll 52. The wrap 51*b* of the fixed scroll 51 and the wrap 52*b* of the movable scroll 52 contact each other at plural places, so plural compression chambers 53 are simultaneously formed. The compression chambers 53 decrease in capacity while moving from the outer peripheral portion of the compression element 50 to the central portion in accompaniment with the revolution of the movable scroll 52.

(2-5) High-pressure Space Forming Member 60

The high-pressure space forming member 60 divides the inside space of the casing 11 into a low-pressure space 61 and a high-pressure space 62. The high-pressure space forming member 60 is provided in the neighborhood of the discharge port 55 of the fixed scroll 51. The high-pressure space 62 extends over a range including the outer side of the discharge port 55, the lower side of the first bearing securing member 70, the periphery of the motor 20, and the periphery of the second bearing securing member 79.

(3) Basic Operation

The motor 20 is driven by electrical power and causes the rotor 22 to rotate. The rotation of the rotor 22 is transmitted to the crankshaft 30, whereby the eccentric portion 32 causes the movable scroll 52 to revolve. The low-pressure refrigerant is sucked from the suction pipe 15 into the low-pressure space 61 and from there goes into the compression chambers 53 positioned in the outer peripheral portion of the compression element 50. The compression chambers 53 move to the central portion while decreasing in capacity and compress the refrigerant in the process. When the compression chambers 53 reach the central portion, the high-pressure refrigerant produced by the compression exits at the discharge port 55 to the outside of the compression element 50, from there flows into the high-pressure space 62, and finally is discharged through the discharge pipe 16 to the outside of the casing 11.

(4) Detailed Structure (4-1) Shapes of Discharge Port 55 and Wrap 52*b* of Movable Scroll 52

Figure 2:
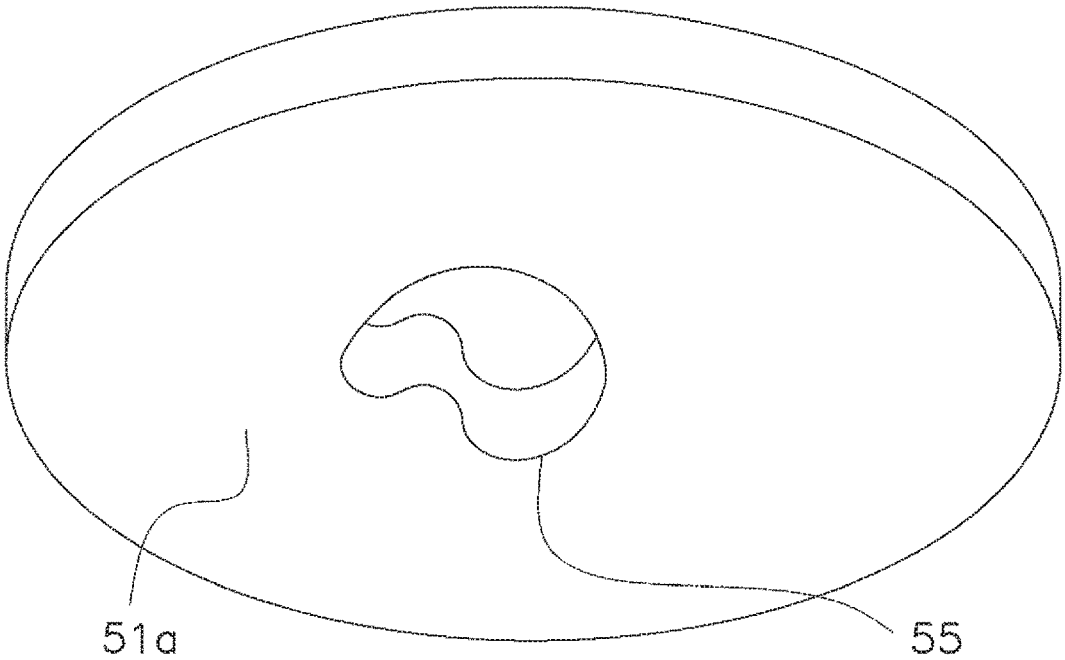
FIG. 2 is a schematic exploded view of a central portion of a compression element 50 pertaining to the first embodiment of the invention.
Figure 2:
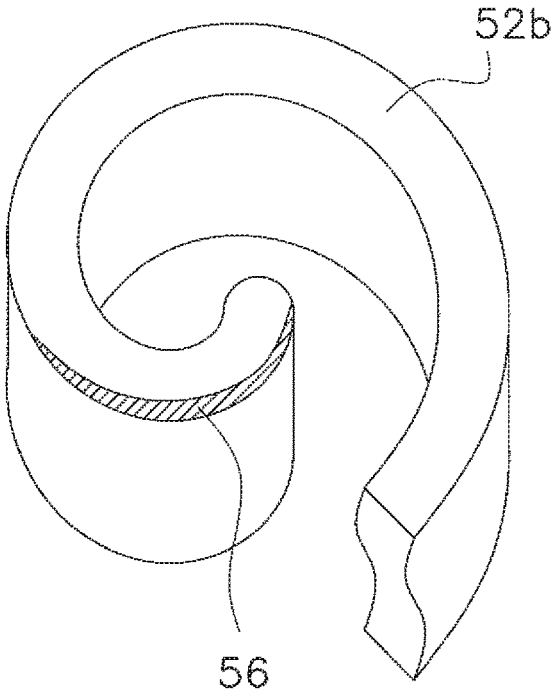

FIG. 2 is a schematic exploded view of the central portion of the compression element 50. In FIG. 2 are shown the lower side of the end plate 51*a* of the fixed scroll 51 and the upper side of the wrap 52*b* of the movable scroll 52 that slides against the end plate 51*a*. The discharge port 55 is provided in the end plate 51*a* of the fixed scroll 51. The discharge port 55 runs through the end plate 51*a*. A cutout portion 56 is provided in an outer edge of the wrap 52*b* of the movable scroll 52 that slides against the end plate 51*a*. The cutout portion 56 shown in FIG. 2 is formed as a sloping portion.

Figure 3:
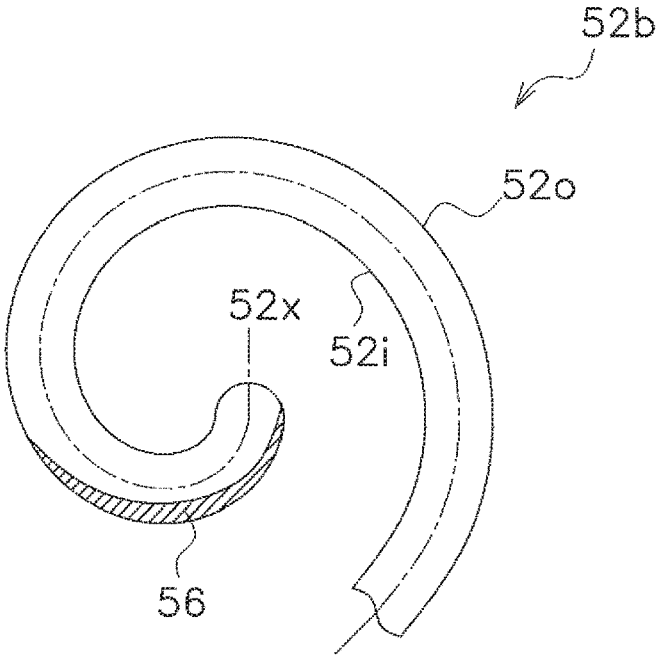
FIG. 3 is a top view of a wrap 52*b* of a movable scroll 52.

FIG. 3 is a top view of the wrap 52*b* of the movable scroll 52. The spiral shape of the wrap 52*b* lies along a center curve 52*x*. The center curve 52*x* is an involute curve, for example. An inner edge 52*i* positioned on the center side of the wrap 52*b* and an outer edge 52*o* positioned on the outer side are spaced apart from each other across the center curve 52*x*, and the dimension of the spacing is in principle a fixed value corresponding to the width of the wrap 52*b*. The cutout portion 56 is formed in the outer edge 52*o* of the wrap 52*b* of the movable scroll 52.

Figure 4:
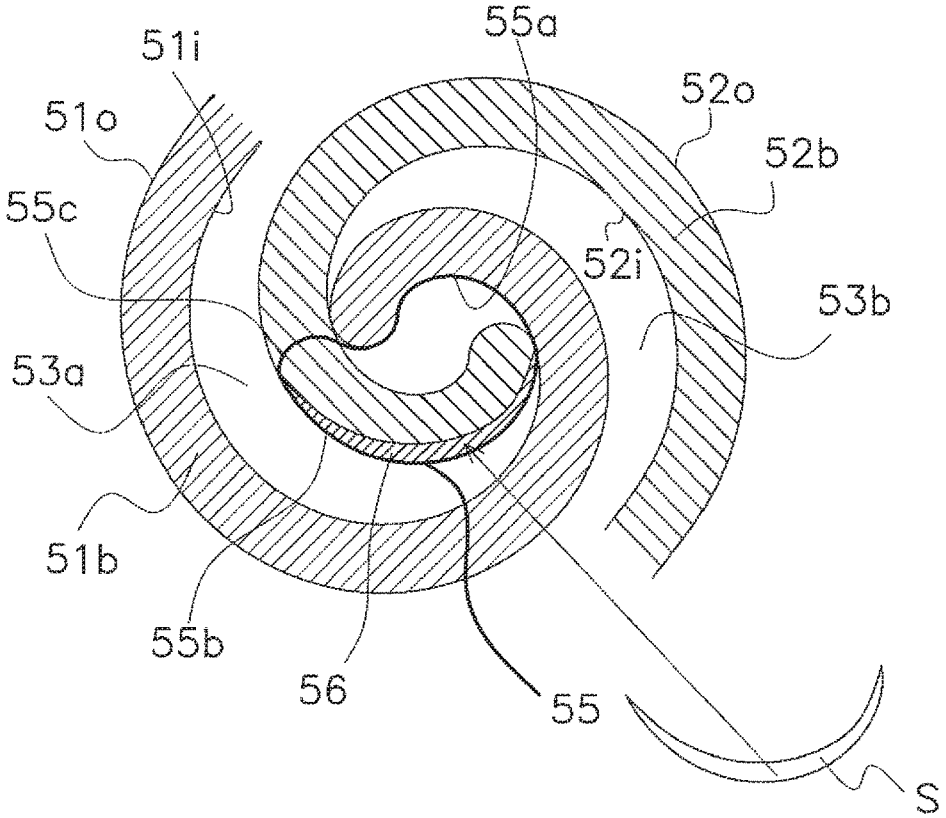
FIG. 4 is a schematic plan view of the central portion of the compression element 50 pertaining to the first embodiment of the invention.

FIG. 4 is a schematic plan view of the central portion of the compression element 50. The wrap 51*b* of the fixed scroll 51 has the same spiral shape as the wrap 52*b* of the movable scroll 52. The position of the wrap 51*b* of the fixed scroll 51 is fixed with respect to the discharge port 55. The wrap 52*b* of the movable scroll 52 relatively moves with respect to the position of the discharge port 55. The plural compression chambers 53 defined by the wrap 51*b* and the wrap 52*b* have two types, A-chambers 53*a* and B-chambers 53*b*. The A-chambers 53*a* are compression chambers defined by an inner edge 51*i* of the wrap 51*b* of the fixed scroll 51 and the outer edge 52*o* of the wrap 52*b* of the movable scroll 52. The B-chambers 53*b* are compression chambers defined by an outer edge 51*o* of the wrap 51*b* of the fixed scroll 51 and the inner edge 52*i* of the wrap 52*b* of the movable scroll 52.

The wrap 52*b* partially covers the discharge port 55 and thereby decides a communication area S that is the area of a portion of the total area of the discharge port 55 that contributes to communication with the A-chamber 53*a*. The wrap 52*b* increases/decreases the communication area S by revolving counter-clockwise.

FIG. 4 shows the position of the wrap 52*b* of the movable scroll 52 at a certain time in one period of revolution. The profile of the discharge port 55 comprises a first section 55*a*, a second section 55*b*, and a third section 55*c*. The first section 55*a* coincides with the inner edge 51*i* of the wrap 51*b* of the fixed scroll 51. The second section 55*b* coincides with the outer edge 52*o* of the wrap 52*b* of the movable scroll 52. The third section 55*c* moves between the inner edge 51*i* of the wrap 51*b* and the outer edge 52*o* of the wrap 52*b*.

The cutout portion 56 contributes to increasing the communication area S. In FIG. 4, the communication area S coincides with the area of the cutout portion 56.

Figure 5:
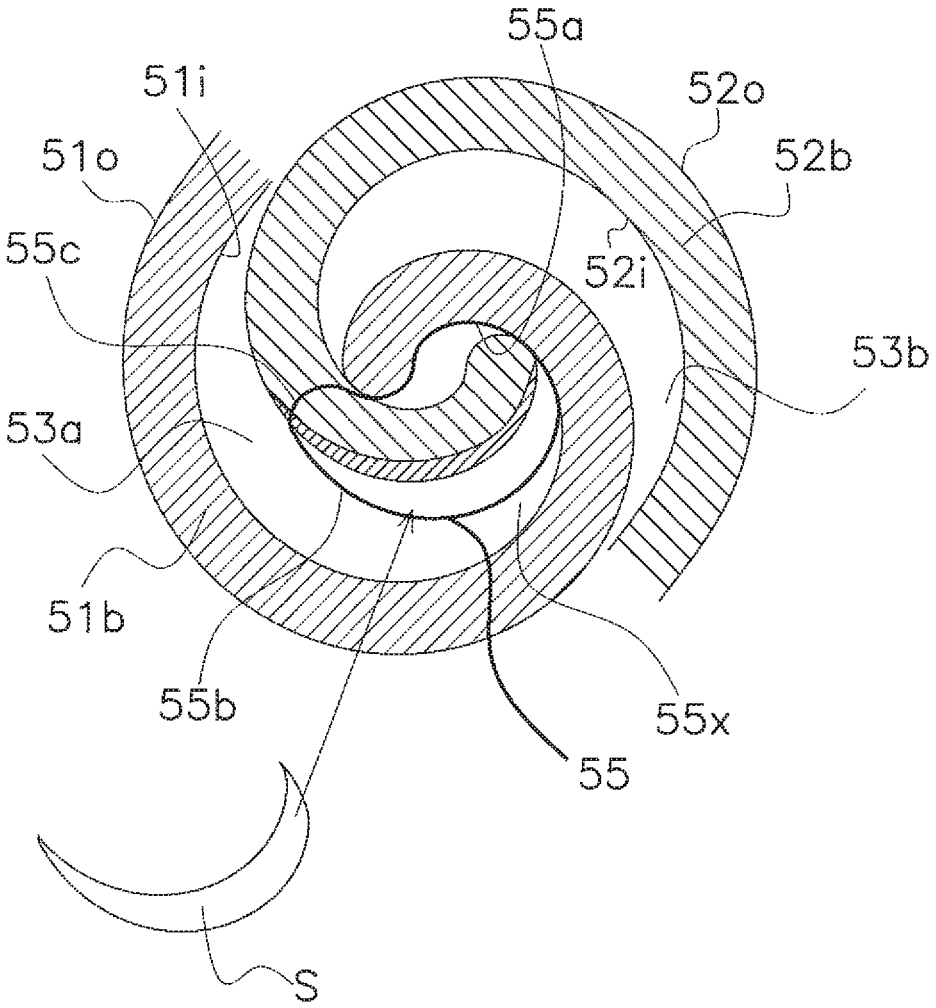
FIG. 5 is a schematic plan view of the central portion of the compression element 50 pertaining to the first embodiment of the invention.

FIG. 5 shows the position of the wrap 52*b* of the movable scroll 52 at a time a little past the time of FIG. 4. The wrap 52*b* moves by revolving movement from the position shown in FIG. 4. In FIG. 5, the communication area S exceeds the area of the cutout portion 56.

(4-2) Change in Communication Area S

Figure 6:
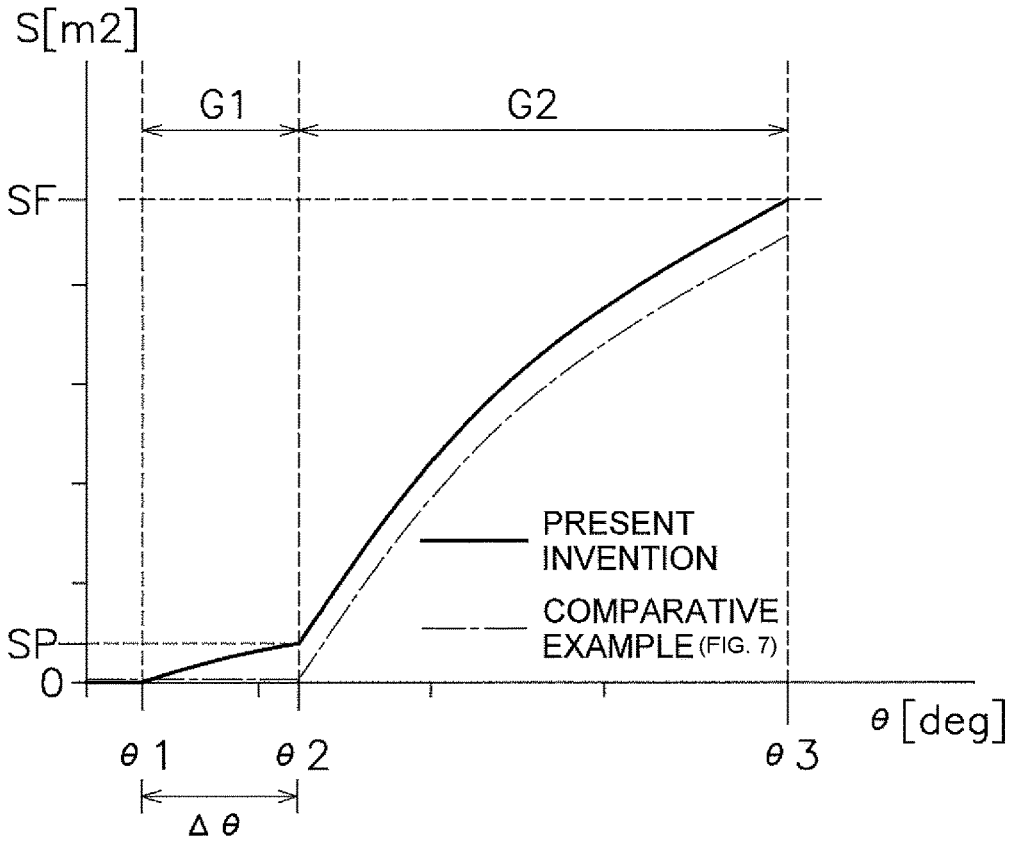
FIG. 6 is a graph showing a change in a communication area S resulting from the rotation of a crankshaft 30.
Figure 7:
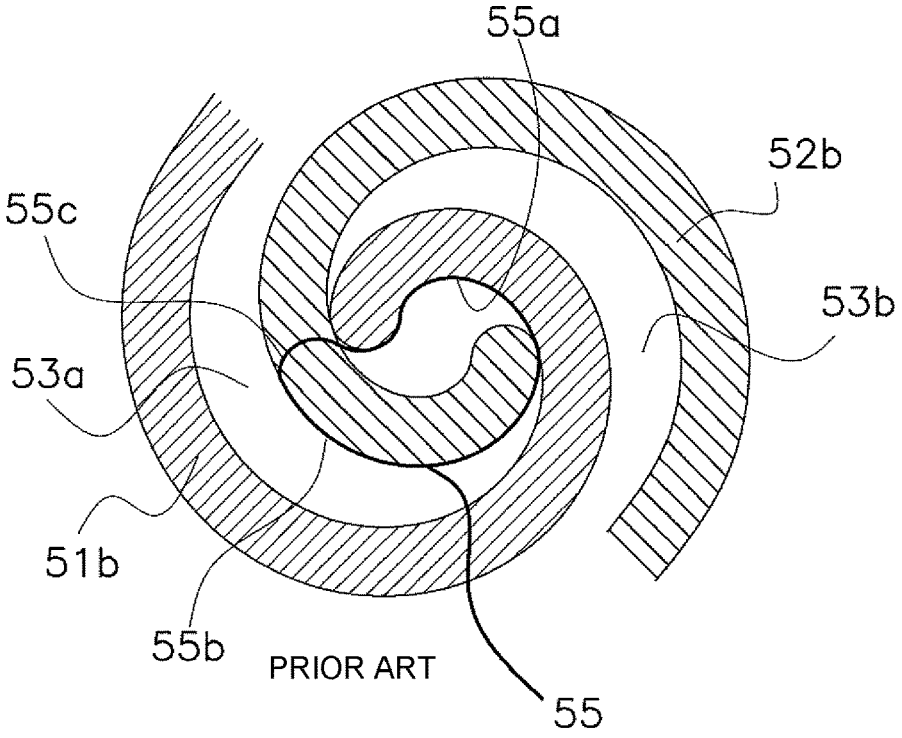
FIG. 7 is a schematic plan view of the central portion of the compression element 50 pertaining to a comparative example.

FIG. 6 is a graph schematically showing a change in the communication area S resulting from the rotation of the crankshaft 30. In the graph is also shown a change in the communication area S of the discharge port 55 of the compression element 50 pertaining to a comparative example shown in FIG. 7. In the comparative example of FIG. 7, in contrast to the configuration pertaining to the invention, the cutout portion 56 is not formed in the wrap 52*b* of the movable scroll 52.

The horizontal axis of the graph in FIG. 6 is a rotation angle position θ of the crankshaft 30. A first rotation angle position θ1 corresponds to a disposition in which the A-chamber 53*a* of the compression element 50 pertaining to the invention and the discharge port 55 start communicating with each other. A second rotation angle position θ2 is a preliminary discharge interval angle Δθ greater than the first rotation angle position θ1. A third rotation angle position θ3 is greater than the second rotation angle position θ2 from the second rotation angle position.

In the configuration pertaining to the comparative example, before the rotation angle position θ reaches the second rotation angle position θ2, the communication area S is zero, and after the rotation angle position θ has reached the second rotation angle position θ2, the communication area S suddenly increases at a large second rate of increase G2. This increase continues at least until the third rotation angle position θ3.

In contrast, in the configuration pertaining to the invention, preceding the increase at the large second rate of increase G2, the communication area S increases at a small first rate of increase G1 as the rotation angle position θ moves from the first rotation angle position θ1 to the second rotation angle position θ2.

(4-3) Operation of Compression Element 50

In the operation of the compression element 50 pertaining to the invention, the cutout portion 56 creates a gap between the sliding surface of the wrap 52*b* and the profile of the discharge port 55 in the time period from the first rotation angle position θ1 to the second rotation angle position θ2, and the fluid refrigerant is discharged through the gap. In this time period, the communication area S increases at the small first rate of increase G1, and discharge with a low flow rate called "preliminary discharge" is performed.

The preliminary discharge is performed over the preliminary discharge interval angle Δθ that is the difference between the second rotation angle position θ2 and the first rotation angle position θ1. The preliminary discharge interval angle is designed so as to be 20° to 60°. After the preliminary discharge has ended, discharge with a high flow rate called "main discharge" is performed in the time period from the second rotation angle position θ2 to the third rotation angle position θ3.

In the preliminary discharge, the communication area S increases from zero to SP. In the main discharge, the communication area S increases from SP to at least SF.

(5) Characteristics (5-1)

When the cutout portion 56 passes through the profile of the discharge port 55, the A-chamber 53*a* of the plural compression chambers 53 and the discharge port 55 communicate with each other in a small flow passage area. Consequently, some of the fluid refrigerant inside the A-chamber 53*a* is discharged at a low flow rate, whereby the pressure of the fluid refrigerant inside the A-chamber 53*a* becomes lower, so backflow of the fluid refrigerant to the A-chamber 53*a* thereafter can be reduced.

(5-2)

The cutout portion 56 is a sloping portion or a step portion. Consequently, it is easy to form the cutout portion 56.

(5-3)

The discharge port 55 is formed in the fixed scroll 51. Consequently, the discharge port 55 does not move, so it is easy to design a guide path for the fluid refrigerant that becomes discharged from the compression element 50.

(5-4)

The discharge port 55 is formed in the center of the fixed scroll 51. Consequently, the fluid refrigerant that has been compressed with high compressibility can be discharged at the center of the wrap 51*b* of the fixed scroll 51.

(5-5)

For a predetermined amount of time after the compression chambers 53 and the discharge port 55 start communicating with each other, that is, as the crankshaft 30 rotates from the first rotation angle position θ1 to the second rotation angle position θ2, the communication area S gently increases. At this time, some of the fluid refrigerant inside the compression chambers 53 is discharged at a low flow rate, whereby the pressure of the fluid refrigerant inside the compression chambers 53 becomes lower. Consequently, backflow of the fluid refrigerant to the compression chambers 53 as the crankshaft 30 thereafter rotates from the second rotation angle position θ2 to the third rotation angle position θ3 can be reduced.

(5-6)

The preliminary discharge interval angle having a predetermined size of 20° to 60° is ensured. Consequently, backflow of the fluid can be more reliably inhibited.

(5-7)

The communication area S may also be set so as to become 7% to 15% of the total area of the discharge port 55 as the crankshaft 30 rotates from the first rotation angle position θ1 to the second rotation angle position θ2. In this case, the preliminary discharge with a low flow rate can be reliably realized.

(5-8)

The second rate of increase G2 in the main discharge with the high flow rate may also be two or more times the first rate of increase G1 in the preliminary discharge with the low flow rate. In this case, the flow rates in the two discharge stages change significantly, so backflow reduction becomes reliable, i.e., backflow reduction is improved.

(5-9)

The third rotation angle position θ3 may be determined so as to be 90° or more greater than the second rotation angle position θ2. In this case, the size of the range of the rotation angle at which the main discharge can be executed can be maintained.

(6) Example Modifications (6-1)

In the above embodiment, the cutout portion 56 is formed in the outer edge 52*o* of the wrap 52*b* of the movable scroll 52. Instead of this, the cutout portion 56 may also be formed in the outer edge 51*o* of the wrap 51*b* of the fixed scroll 51.

According to this configuration, backflow of the fluid can be inhibited or reduced in a case where, because of design constraints, it is necessary to provide the discharge port 55 in the movable scroll 52.

(6-2)

In the above embodiment, the discharge port 55 is formed in the center of the fixed scroll 51. Instead of this, the discharge port 55 may also be formed in the center of the movable scroll 52.

According to this configuration, the discharge port 55 comparatively does not move, so it is comparatively easy to design a guide path for the fluid refrigerant that becomes discharged.

(6-3)

Figure 8:
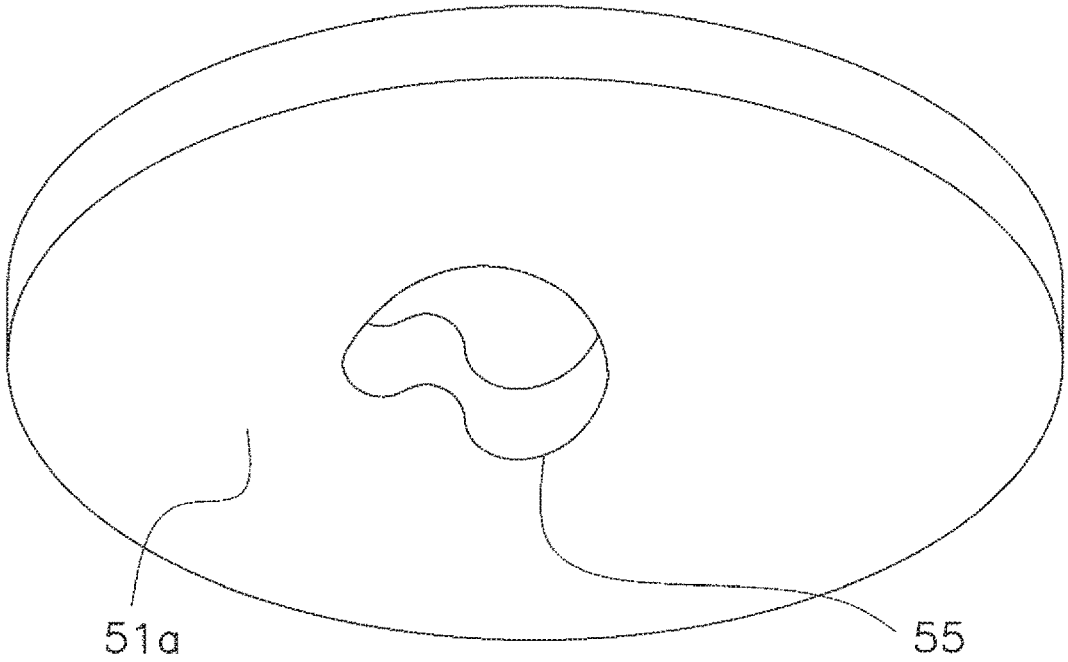
FIG. 8 is a schematic exploded view of the central portion of the compression element 50 pertaining to an example modification of the first embodiment of the invention.
Figure 8:
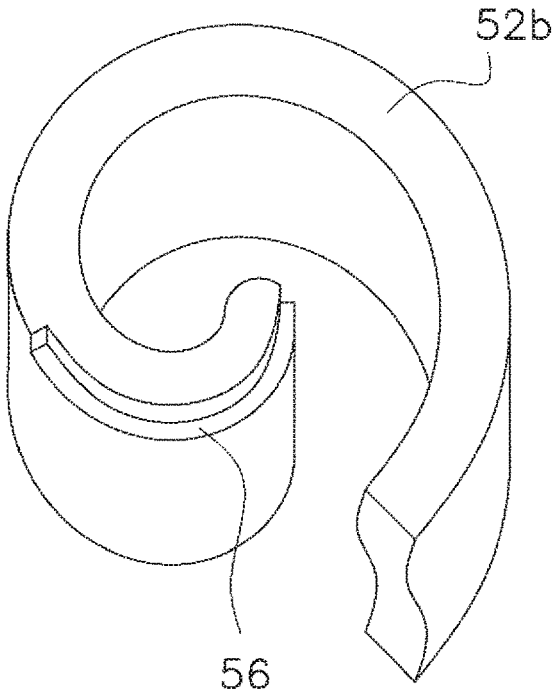

In the above embodiment, the cutout portion 56 is formed as a sloping portion as shown in FIG. 2. Instead of this, the cutout portion 56 may also be formed as a step portion as shown in FIG. 8.

Second Embodiment (1) Configuration

Figure 9:
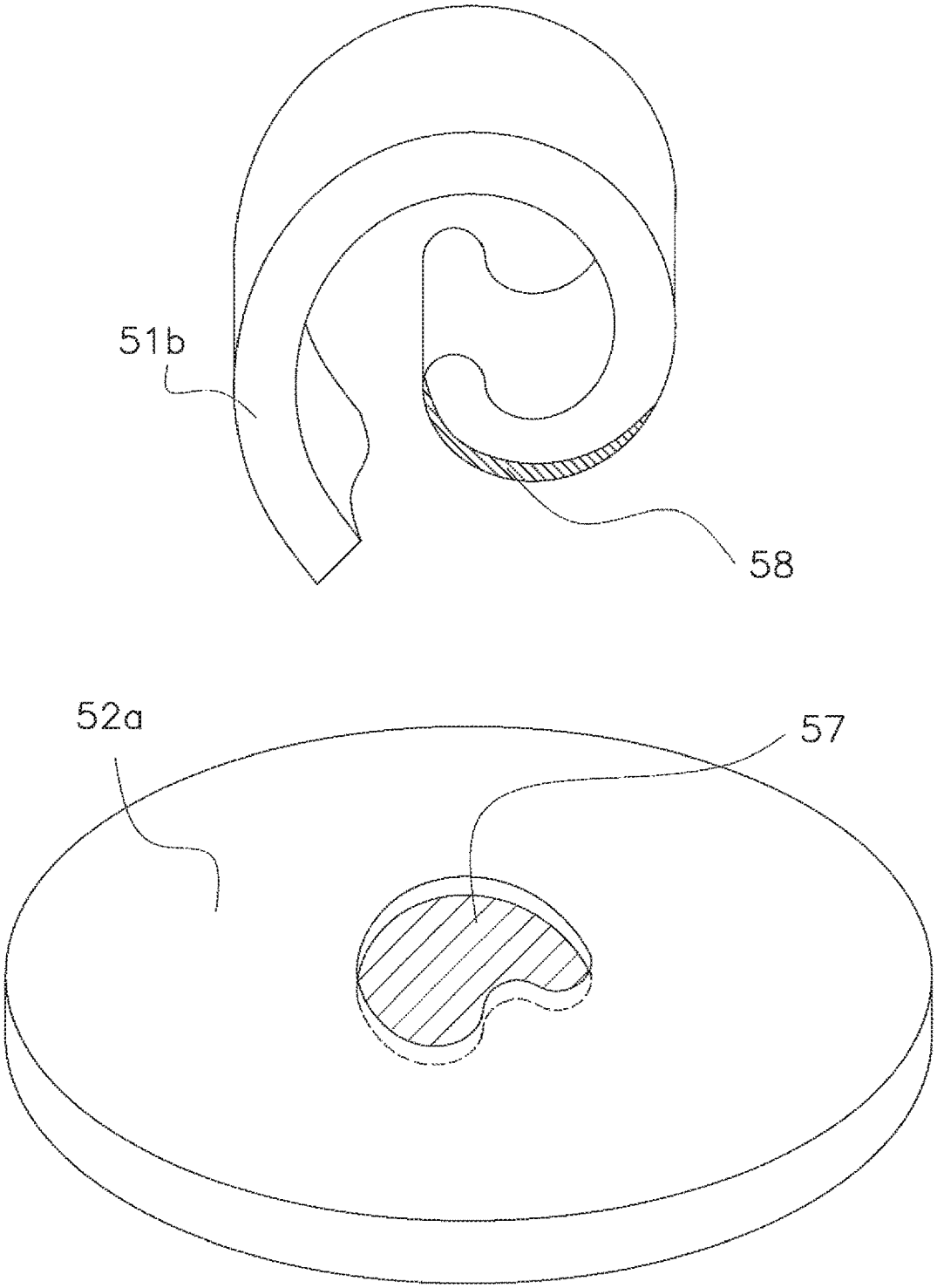
FIG. 9 is a schematic exploded view of the central portion of the compression element 50 pertaining to a second embodiment of the invention.

FIG. 9 is a schematic exploded view of the central portion of the compression element 50 of the scroll compressor 10 pertaining to a second embodiment of the invention. The second embodiment differs from the first embodiment in the structures of the wrap 51*b* of the fixed scroll 51 and the end plate 52*a* of the movable scroll 52, but configurations other than those are the same as those of the first embodiment.

In FIG. 9 are shown the lower side of the wrap 51*b* of the fixed scroll 51 and the upper side of the end plate 52*a* of the movable scroll 52 that slides against the wrap 51*b*. A recessed portion 57 is further provided in the center of the end plate 52*a* of the movable scroll 52. The profile of the recessed portion 57 is congruent with the profile of the discharge port 55. The recessed portion 57 has a depth of 2 mm, for example, and does not run through the end plate 52*a*.

A cutout portion 58 is further provided in the wrap 51*b* of the fixed scroll 51 that slides against the end plate 52*a*. The cutout portion 58 shown in FIG. 9 is a sloping portion, but instead of this the cutout portion 58 may also be a step portion.

Figure 10:
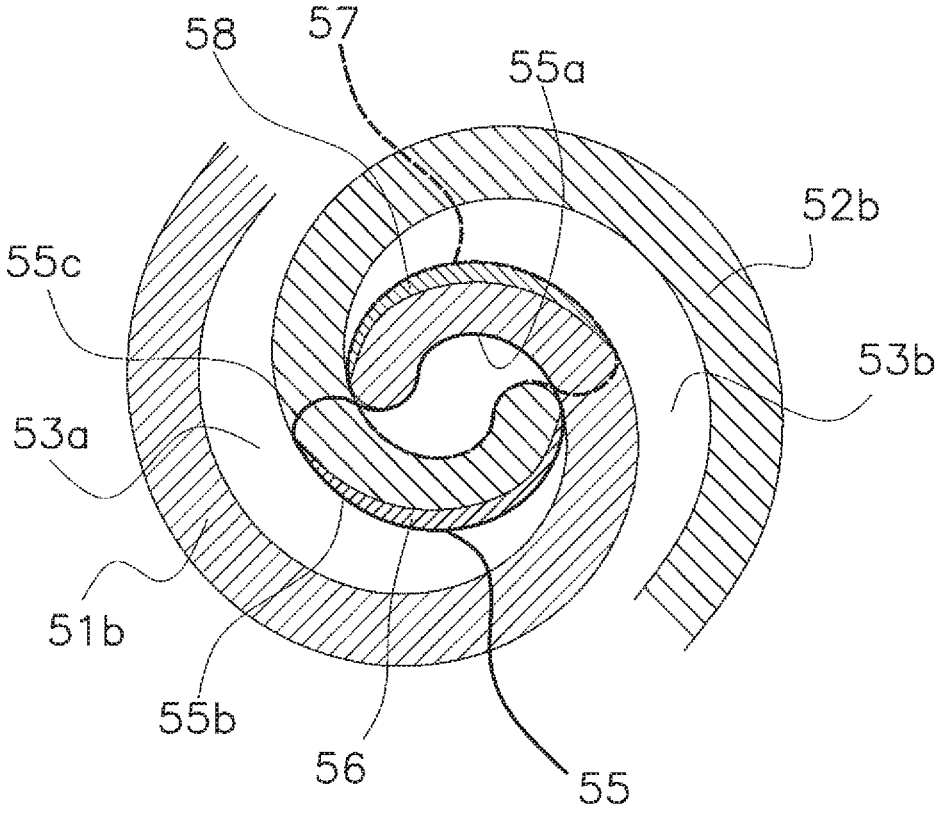
FIG. 10 is a schematic plan view of the central portion of the compression element 50 pertaining to the second embodiment of the invention.

FIG. 10 is a schematic plan view of the central portion of the compression element 50. The positional relationship between the profile of the discharge port 55 and the profile of the recessed portion 57 is point-symmetrical in the same way as the positional relationship between the wrap 51*b* of the fixed scroll 51 and the wrap 52*b* of the movable scroll 52. The recessed portion 57 communicates with the discharge port 55 in the central region of the compression element 50.

(2) Characteristics

The cutout portion 56 of the wrap 52*b* of the movable scroll 52 contributes to increasing the communication area relating to the communication between the discharge port 55 and the A-chamber 53*a*. In the same way, the cutout portion 58 of the wrap 51*b* of the fixed scroll 51 contributes to increasing the communication area relating to the communication between the discharge port 55 and the B-chamber 53*b*.

According to this configuration, when the cutout portion 58 passes through the profile of the recessed portion 57, the B-chamber 53*b* of the compression chambers 53 and the recessed portion 57 communicate with each other in a small flow passage area. The recessed portion 57 communicates with the discharge port 55 in the central region of the compression element 50. Consequently, some of the fluid refrigerant inside the B-chamber 53*b* is discharged at a low flow rate, whereby the pressure of the fluid refrigerant inside the B-chamber 53*b* becomes lower. As a result, backflow of the fluid refrigerant not only to the A-chamber 53*a* but also to the B-chamber 53*b* can be reduced.

(3) Example Modifications

The example modifications of the first embodiment may also be applied to the second embodiment.

What is claimed is:

1. A scroll compressor comprising:

a fixed scroll including a fixed scroll end plate;

a movable scroll revolvable with respect to the fixed scroll, the movable scroll including a movable scroll wrap, the fixed scroll and the movable scroll defining compression chambers configured to compress a fluid; and a crankshaft rotatable to cause the movable scroll to revolve, a discharge port being formed in the fixed scroll end plate, and a cutout portion being formed in the movable scroll wrap, the movable scroll wrap at least partially covering the discharge port in order to change a communication area, the communication area being an area of a portion of a total area of the discharge port that contributes to communication with the compression chambers, the discharge port, the movable scroll wrap, and the cutout portion being configured and arranged such that as the crankshaft rotates from a first rotation angle position to a second rotation angle position, the communication area increases at a first rate of increase, the first rotation angle position corresponding to a disposition in which the compression chambers and the discharge port start communicating with each other, and the second rotation angle position being a preliminary discharge interval angle greater than the first rotation angle position, and as the crankshaft rotates from the second rotation angle position to a third rotation angle position, the communication area increases at a second rate of increase, the third rotation angle position being greater than the second rotation angle position, the second rate of increase being greater than the first rate of increase, and the third rotation angle position being greater than the second rotation angle position by 90° or more.

2. The scroll compressor according to claim 1, wherein the cutout portion is a sloping portion or a step portion.

3. The scroll compressor according to claim 2, wherein the fixed scroll has a fixed scroll wrap extending from the fixed scroll end plate, the movable scroll has a movable scroll end plate, and the movable scroll wrap extends from the movable scroll end plate.

4. The scroll compressor according to claim 1, wherein the fixed scroll has a fixed scroll wrap extending from the fixed scroll end plate, the movable scroll has a movable scroll end plate, and the movable scroll wrap extends from the movable scroll end plate.

5. The scroll compressor according to claim 4, wherein the discharge port is formed in a center of the fixed scroll end plate, and the cutout portion is formed in an outer edge of the movable scroll wrap.

6. The scroll compressor according to claim 4, wherein a recessed portion is formed in the movable scroll end plate, and an additional cutout portion is formed in the fixed scroll wrap.

7. The scroll compressor according to claim 1, wherein the preliminary discharge interval angle is 20° to 60°.

8. The scroll compressor according to claim 1, wherein the communication area in the second rotation angle position is 7% to 15% of the total area of the discharge port.

9. The scroll compressor according to claim 1, wherein the second rate of increase is two or more times the first rate of increase.

10. The scroll compressor according to claim 1, wherein the cutout portion is provided on an outer edge of the movable scroll wrap, the cutout portion being arranged and configured to create a gap between a sliding surface of the movable scroll wrap and the profile of the discharge port when the crankshaft rotates from the first rotation angle position to the second rotation angle position.

* * * * *